US008627616B2

(12) United States Patent
Caboni

(10) Patent No.: US 8,627,616 B2
(45) Date of Patent: Jan. 14, 2014

(54) PRE-FABRICATED RIBBED PANEL TO BE INSTALLED EITHER IN A HORIZONTAL, VERTICAL OR INCLINED CONDITION

(76) Inventor: Michele Caboni, Oristano (IT)

( * ) Notice: Subject to any disclaimer, the term of this patent is extended or adjusted under 35 U.S.C. 154(b) by 0 days.

(21) Appl. No.: 13/261,247

(22) PCT Filed: Oct. 1, 2010

(86) PCT No.: PCT/IB2010/002502

§ 371 (c)(1),
(2), (4) Date: Sep. 18, 2012

(87) PCT Pub. No.: WO2011/039628

PCT Pub. Date: Apr. 7, 2011

(65) Prior Publication Data

US 2013/0014454 A1 Jan. 17, 2013

(30) Foreign Application Priority Data

Oct. 2, 2009 (IT) ..... MI2009A1693

(51) Int. Cl.
*E04D 13/18* (2006.01)

(52) U.S. Cl.
USPC ..... 52/173.1

(58) Field of Classification Search
USPC ..... 52/173.1
See application file for complete search history.

(56) References Cited

U.S. PATENT DOCUMENTS

| | | | | |
|---|---|---|---|---|
| 6,298,622 | B1 * | 10/2001 | Cretti | 52/309.7 |
| 6,817,150 | B1 * | 11/2004 | Boeshart | 52/309.6 |
| 2006/0137269 | A1 * | 6/2006 | Di Lorenzo | 52/250 |
| 2008/0041004 | A1 * | 2/2008 | Gibbar et al. | 52/309.12 |
| 2009/0199500 | A1 * | 8/2009 | LeBlang | 52/414 |

* cited by examiner

*Primary Examiner* — Mark Wendell
(74) *Attorney, Agent, or Firm* — Law Offices John A. Parrish

(57) ABSTRACT

A prefabricated ribbed panel for installation either in a horizontal, vertical or inclined condition, characterized in that said panel comprises a caisson block (1) made of an inert insulating material, defining a plurality of recesses (2) for housing therein a longitudinal reinforcement structure (10) which can be embedded in a first concrete casting (11) made at a concrete casting shop; a first finishing slab floor (13) with an electrowelded network (15) at panel joining regions being moreover provided.

16 Claims, 13 Drawing Sheets

PRE-FABRICATED RIBBED PANEL TO BE INSTALLED EITHER IN A HORIZONTAL, VERTICAL OR INCLINED CONDITION

BACKGROUND OF THE INVENTION

The present invention relates to a prefabricated ribbed panel to be installed either in a horizontal, vertical or inclined condition.

As is known, regular reinforced concrete floors of a flat intrados type constitute at present the approach to be selected, for achieving walking-on or covering structures: however, these constructions are usually made by rather inefficient making processes.

Also known is the fact that a very important problem to be solved in building a construction, is that associated to manual labor, safety, certification, making time aspects, thereby it is not possible to favor, as in the past, a less cost of raw materials and structural element per se.

Prior trellis or lattice structures are conventionally coupled to further structure elements usually made of brickwork, polystyrene or cement materials, which are assembled by operating casting operations, after having applied reinforcement bar elements, which are made rigid with the overall structure by a top binding layer, having usually a thickness of 4-5 cm.

The floors, in particular, have a comparatively small length ribs, the size of which depends on the trellis or lattice structure, and, moreover, they offer rather reduced spaces for engaging reinforcement iron rods therein, and, usually, present bearing elements of solid cross-sections.

Up to a proper cast or poured material ageing, the mechanical strength of the construction depends on the lattice elements exclusively, as well as on a plurality of temporary struts arranged near with one another; on the thus made construction plank, which has poor safety features, several persons operate, such as carpenters, rodmen, masons, unskilled workers and safety and so on operators.

In this connection, it should be pointed out that the brickwork base or bottom arrangement cannot be safely used in wet or moist environments.

The other materials provide a poor adhesion of the plaster to the intrados thereby favoring a formation of gaps, particularly in the presence of large temperature variations.

Moreover, it is difficult and expensive to provide the floor with auxiliary throughgoing pipe systems or apparatus.

Furthermore, to provide a good resistance against fire and a proper acoustic, thermal and hygrometric insulation, it is necessary to perform a lot of additional operations.

It should be moreover pointed out that in this construction field, are also conventionally used polystyrene and derivative materials thereof which have a very low weight, are inexpensive and provide satisfactory thermally insulating properties.

The use of prefabricated pre-pressed panels, either lightened or not, is not an efficient solution in a case of small inter-axes, or if an aesthetically acceptable result is required.

With respect to prefabricated panel curtain walls, the latter usually have at least a finished outer face, but it is not possible to engage plants or apparatus therein.

Moreover, the panels must be properly joined to one another, cannot be made rigid with the overall construction, they cannot be substantially loaded, and do not allow unstandardized openings to be easily made.

In this connection, it is also known the fact that it is possible to make light panels to be assembled by dry assembling methods, and comprising a plurality of joined blocks adapted to achieve satisfactory thermally-acoustically-hygrometrically insulating properties: however, they cannot be easily provided with autonomous strength capability and, moreover, it is not possible to provide their vertical or inclined surfaces, with satisfactory constructional properties.

In fact, no system exists at present for providing the above light panels with those same characteristics of their horizontal, vertical and inclined elements, and these characteristics may be achieved only by adjoining different materials and using different making methods in combination.

Thus, in the prior art no satisfactory approach is available for solving the current civil building field problems.

SUMMARY OF THE INVENTION

Accordingly, the aim of the present invention is to overcome the above mentioned problems by providing a prefabricated ribbed panel which may be indifferently arranged either in a horizontal, vertical or inclined position and in which, for elements mainly curved to be made, is adapted to operate as a self bearing ribbed slabs or floors, having a fire resistant flat intrados, with further acoustic insulating, moisture adjusting and temperature insulating properties, characterized by a significative self-bearing capability in a dry assembling method thereof.

Within the scope of the above mentioned aim, a main object of the invention is to provide such a panel which, in case of mainly pressed elements, such as curtain and bearing wall panels, may be used as an alternative to brick or block walls or prefabricated cement and polystyrene panels, allowing to use, in a dry construction method, self-bearing or self-supporting elements, optionally provided, in their inside, with ventilating systems, adapted to be made with any freely selectable sizes and shapes, and adapted to hold therein pillars, curbs, beams and withdrawable systems.

Another object of the present invention is to provide such a prefabricated ribbed panel which, owing to its specifically designed making features, is very reliable and safe in operation.

Yet another object of the present invention is to provide such a prefabricated ribbed panel, adapted to be installed either in a horizontal, vertical or inclined condition, which can be easily made starting from easily commercially available elements and materials and which, moreover, is very competitive from a mere economic standpoint.

According to one aspect of the present invention, the above mentioned aim and objects, as well as yet other objects, which will become more apparent hereinafter, are achieved by a prefabricated half-made ribbed panel, adapted to be installed either in a horizontal, vertical or inclined condition, characterized in that said prefabricated panel comprises a caisson or formwork block, made of an inert insulating material, defining a plurality of recesses for housing therein a longitudinal reinforcement construction, which may embedded in a concrete casting material made at a casting shop, a first finishing floor slab including a electrowelded network at the panel joining regions being moreover provided.

Said panel, which is a variable geometry panel, may comprise either unidirectional or bidirectional ribs, that is a net rib arrangement.

BRIEF DESCRIPTION OF THE DRAWINGS

Further characteristics and advantages of the present invention will become more apparent hereinafter from the following detailed disclosure of preferred, though not exclusive, embodiments of a prefabricated ribbed panel, adapted to be installed either in a horizontal, vertical or inclined position, which is illustrated, by way of an indicative, but not limitative, example in the accompanying drawings, where.

DESCRIPTION OF THE PREFERRED EMBODIMENTS

Figure 2:
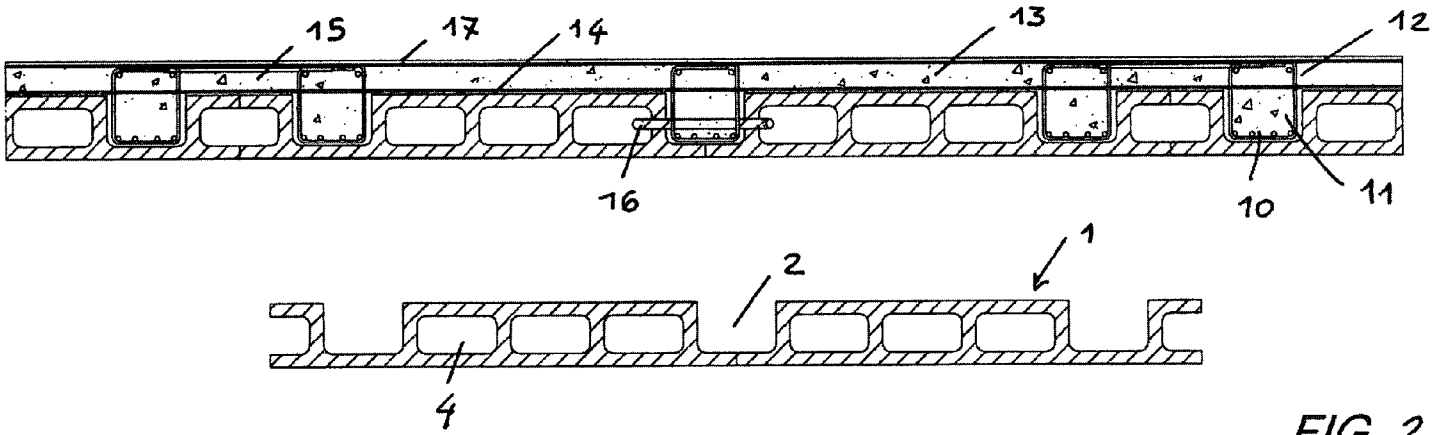
FIGS. 1 to 7 show, respectively, a caisson or formwork block having mutually different dimensions and cross-sections and a single-floor slab ribbed panel.
Figure 1:
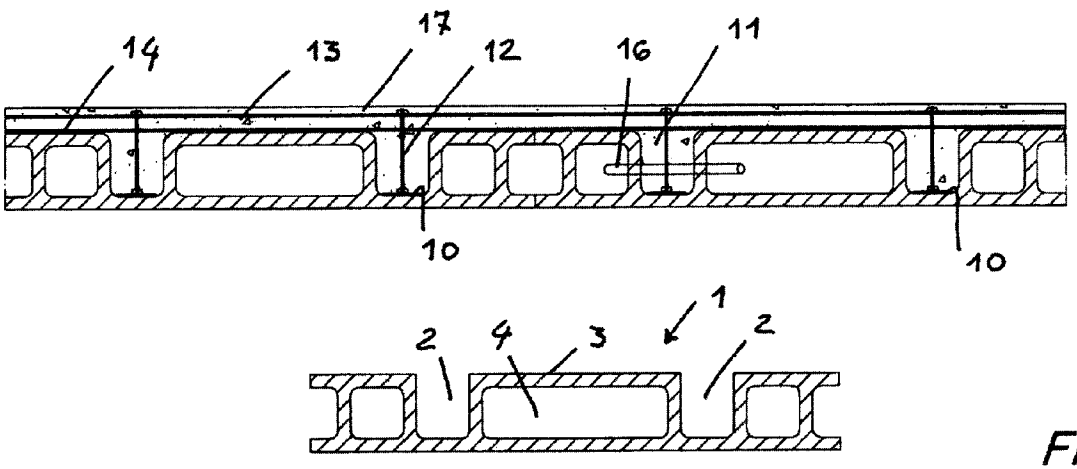
Figure 3:
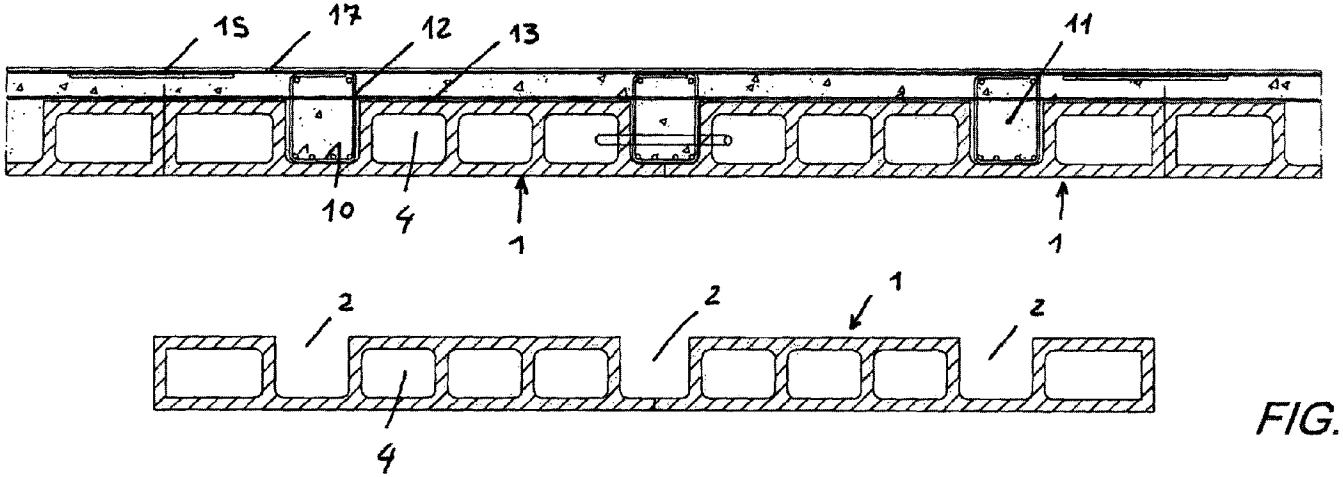
Figure 4:
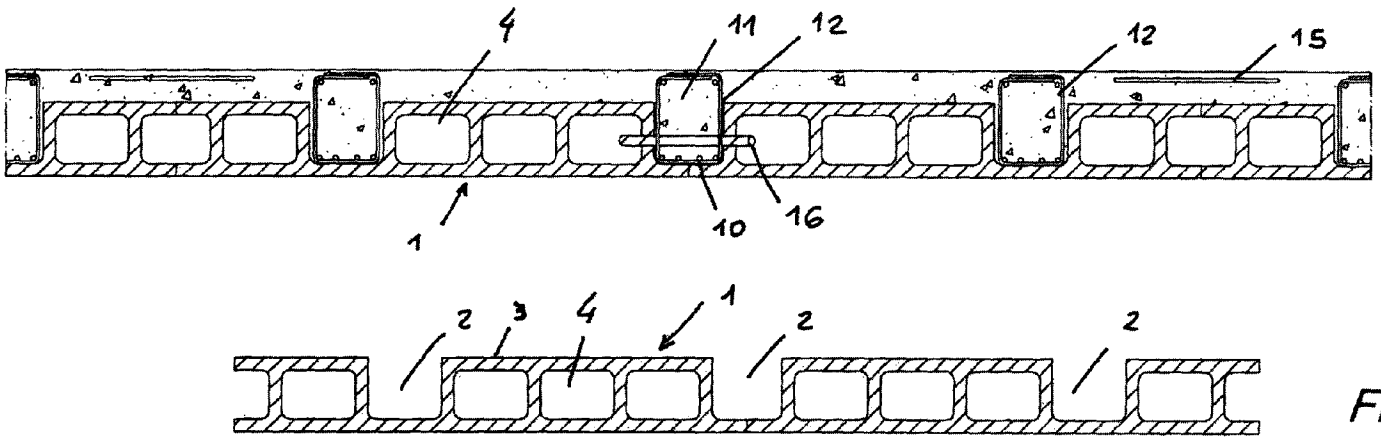
Figure 5:
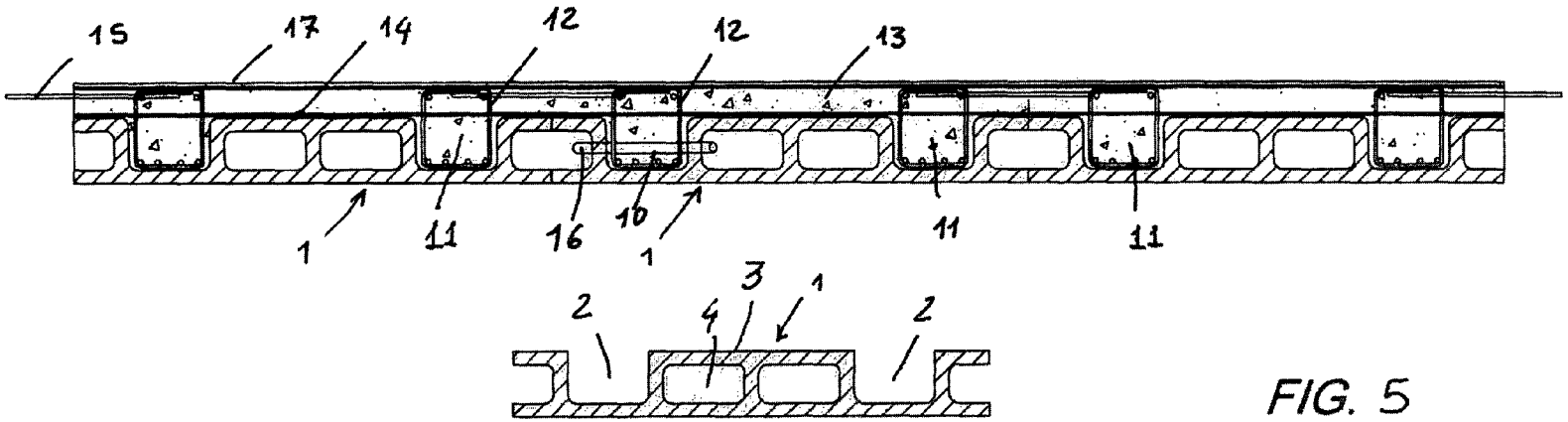
Figure 7:
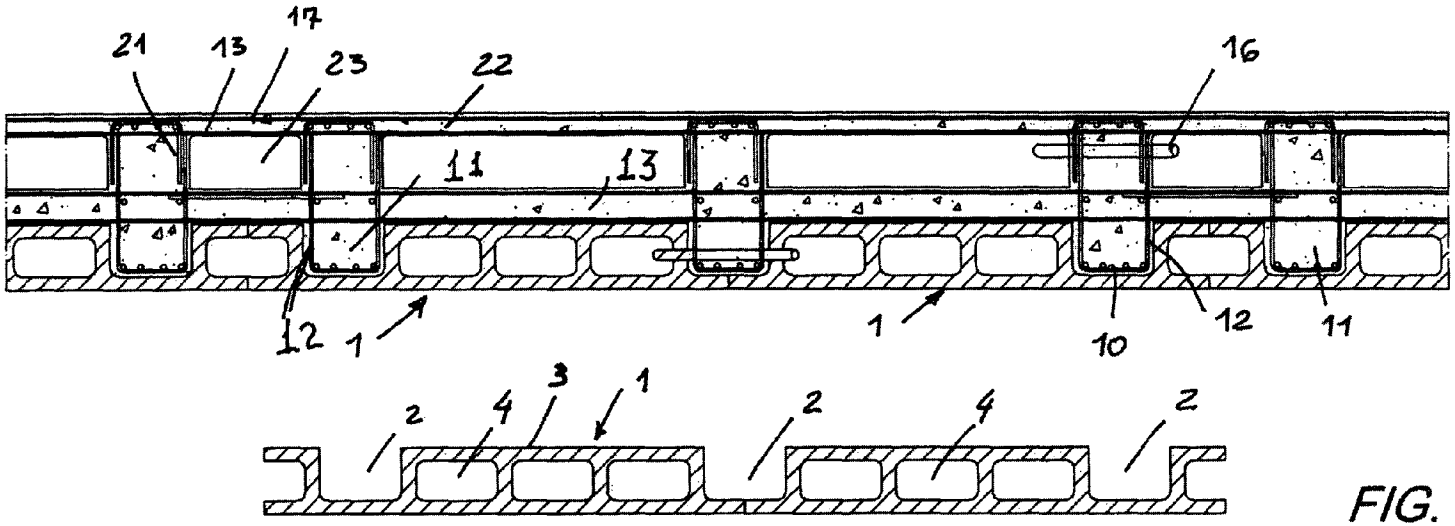
Figure 6:
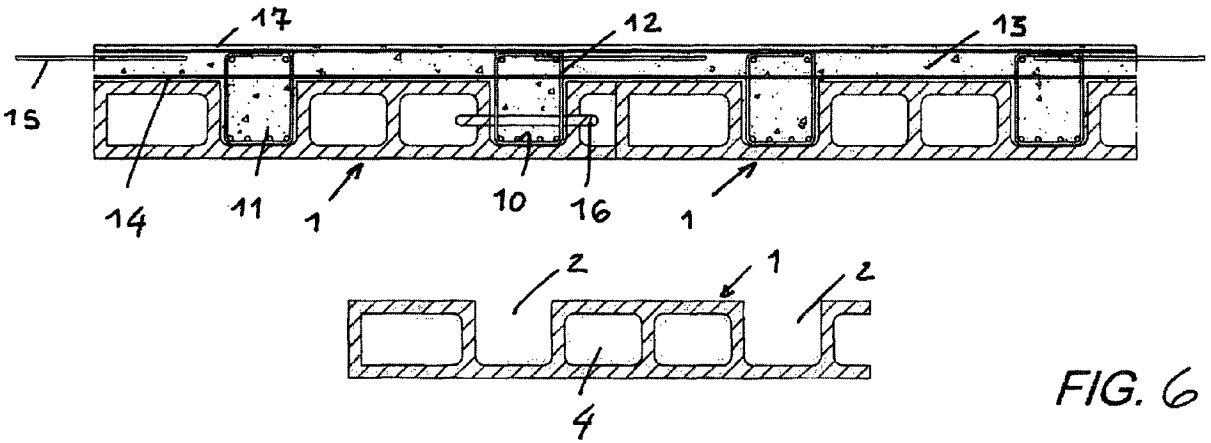

With reference to the number references of the above mentioned figures, the prefabricated ribbed panel, adapted to be installed either in a horizontal, vertical or inclined position or condition, according to the present invention, comprises a caisson or formwork block, always indicated by the reference number 1, which may have a lot of different configurations, depending on the panel type to be made, and on required width dimensions and constructional features.

In general, said caisson or formwork block 1 is made of an insulating material, "inertized" to a "zero" class and being so constructed as to define a plurality of recesses 2 alternating with projecting bodies 3, which define either one or more hollow or empty channels 4, therein, as necessary, it is possible to engage different materials.

In this connection it should be pointed out that said caisson block 1 is preferably formed by a foamed or extruded polystyrene, plywood, cement-wood, cement mixed perlite or other adhesive materials, or it may also be made of a pumice concrete material or any other suitable insulating materials.

Each said caisson block allows to make a respective ribbed panel by using a longitudinal reinforcement structure 10, which is embedded in a first concrete casting 11, which may be directly made at a casting shop and will mainly affect the recesses 2.

In addition to the reinforcement structure 10, it is also possible to provide embedding brackets 12 which, at the installation time, may be embedded in a first finishing floor slab 13, which may be made of a concrete casting in which is embedded a finishing or reinforcement network 14 and an electrowelded network 15, at the panel joining regions.

Moreover, it is possible to provide throughgoing ducts 16, allowing systems and recessed apparatus to be installed, for example, through a ceiling.

An integrating reinforcement structure 17, for improving the construction strength characteristics, may also be herein provided.

In particular, for enhancing the strength characteristics of the construction, it is possible to provide, in a single floor slab panel, a reinforcing trellis or lattice, generally indicated by the reference number 20, which is embedded in the casting provided for forming the floor slab.

Double floor slab panels may also be provided.

Figure 8:
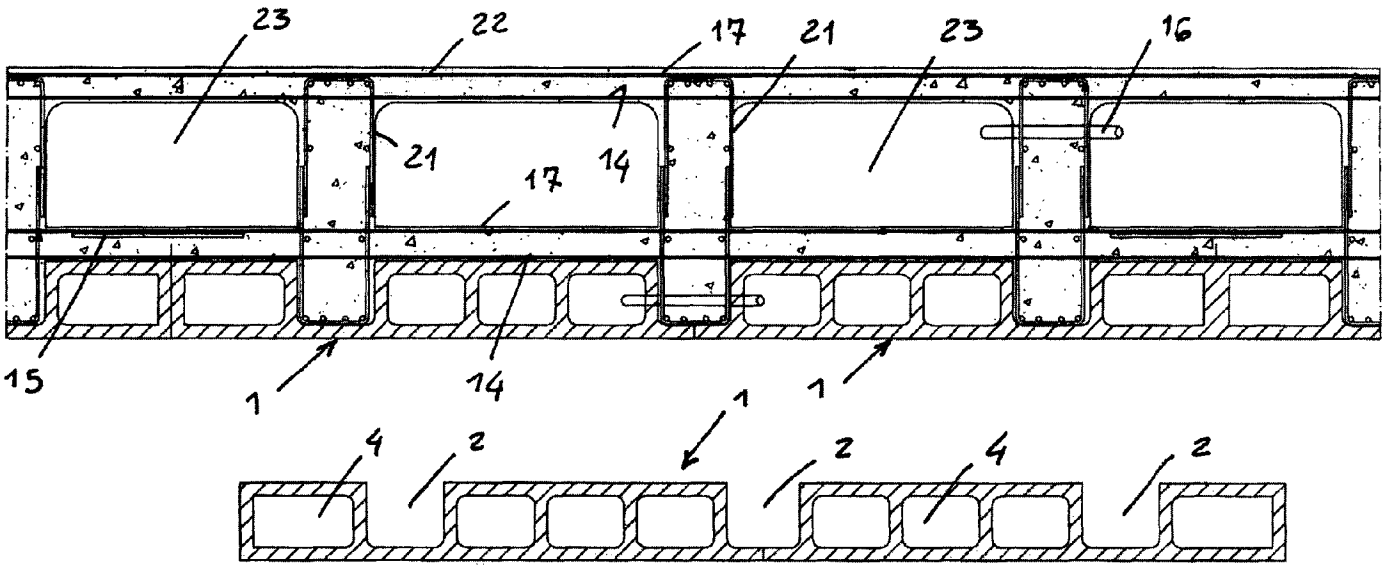
FIGS. 8 to 11 show, respectively, a caisson or formwork block with different cross-sections, thereon a double floor slab panel is made.
Figure 9:
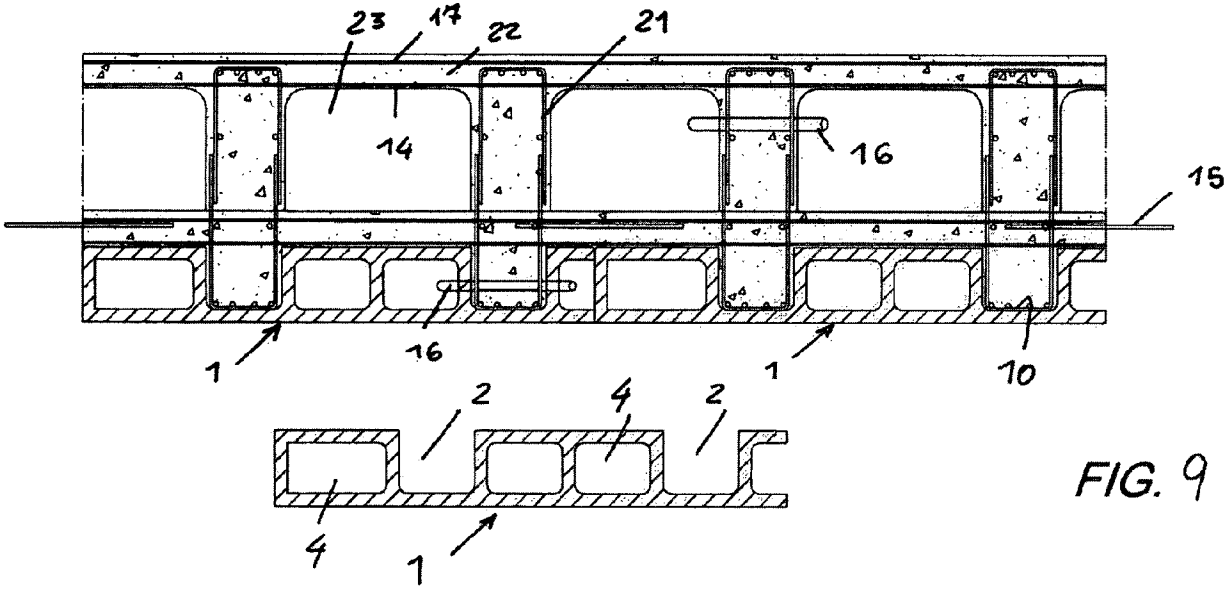
Figure 10:
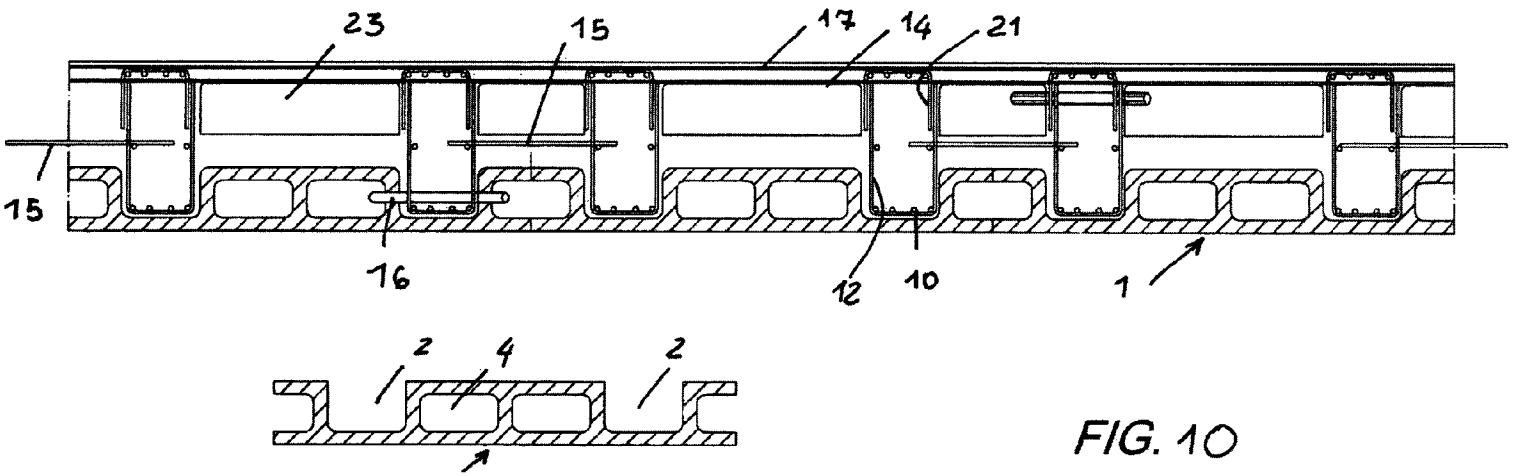
Figure 11:
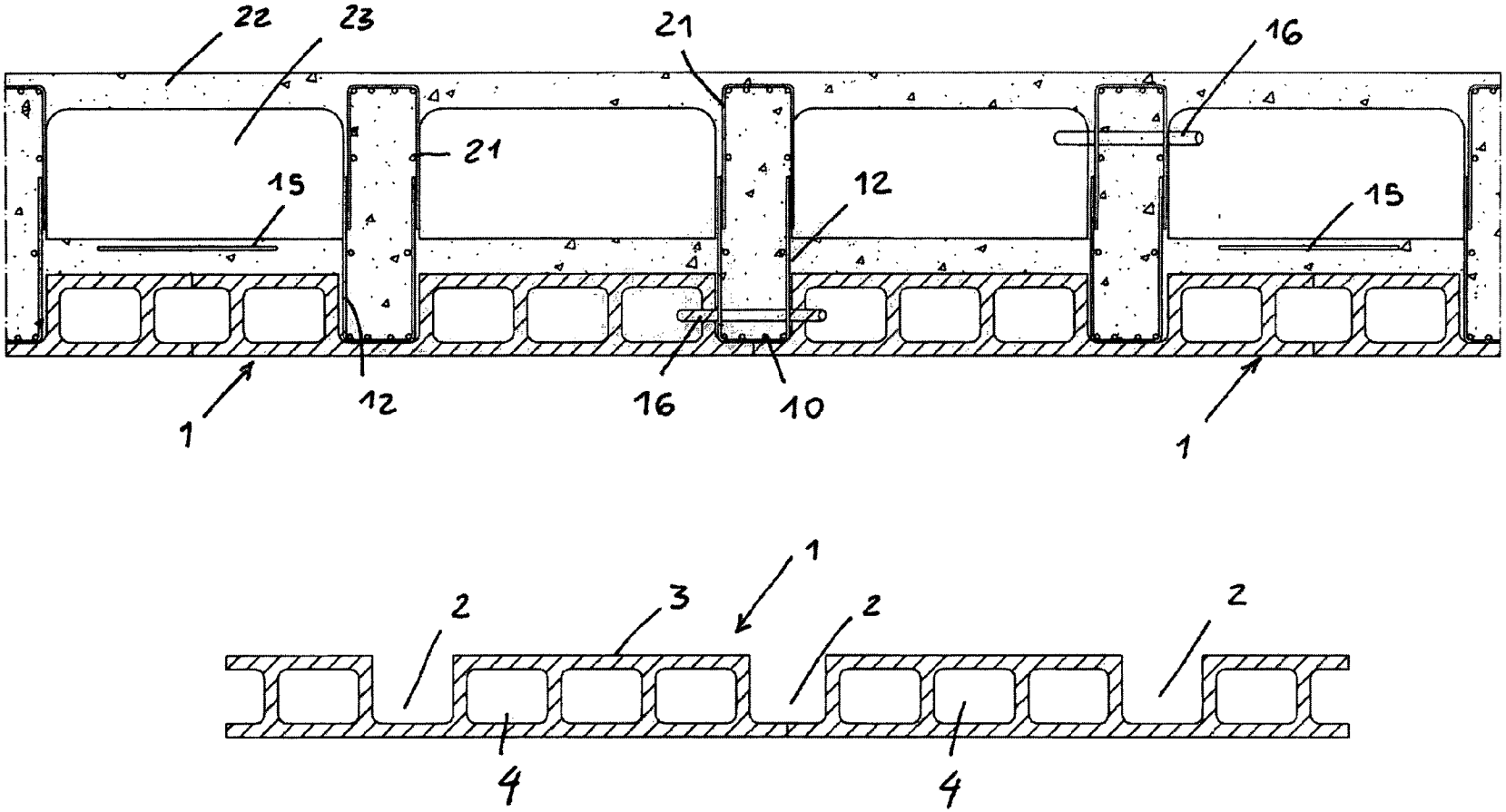
Figure 12:
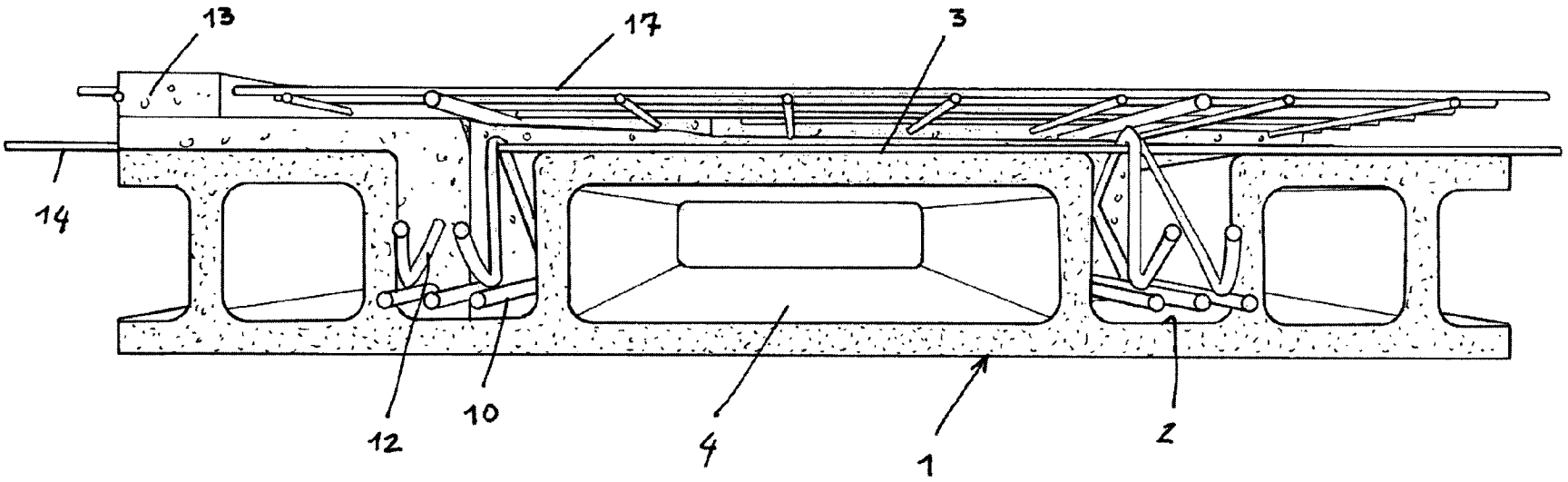
FIG. 12 is a front perspective view showing a single floor slab panel.
Figure 13:
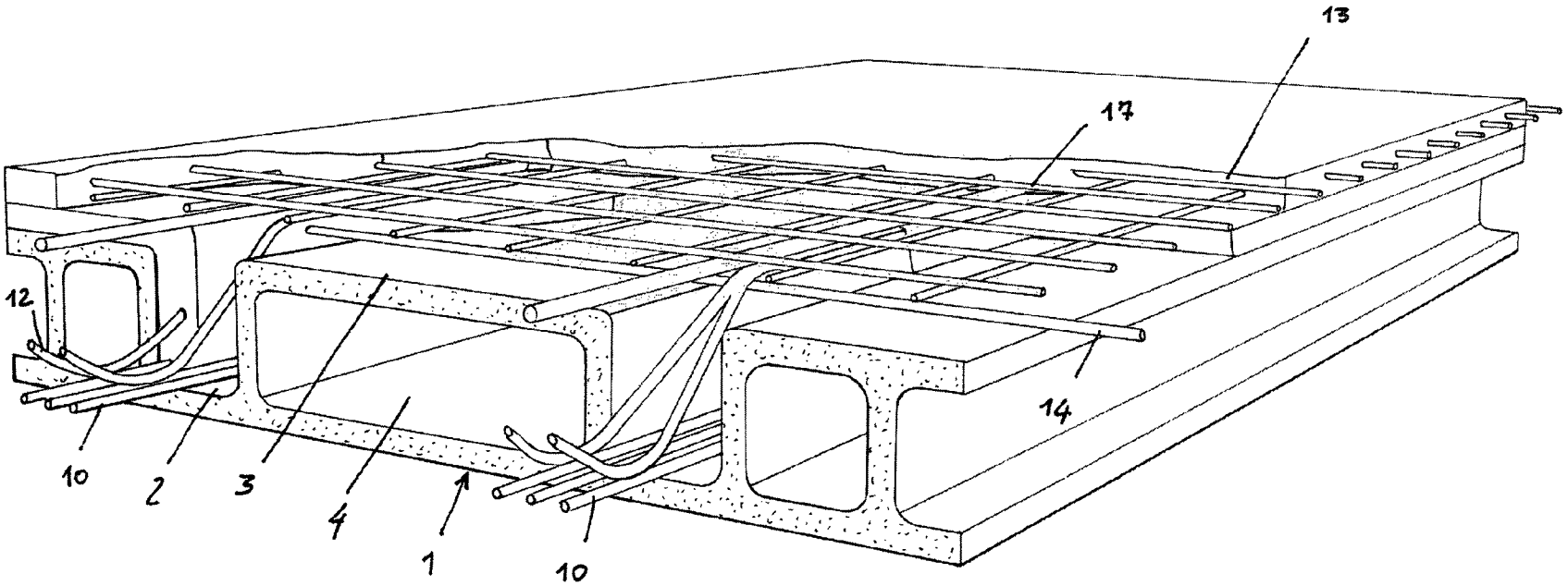
FIG. 13 is a further perspective view also showing a single-slab floor panel.
Figure 14:
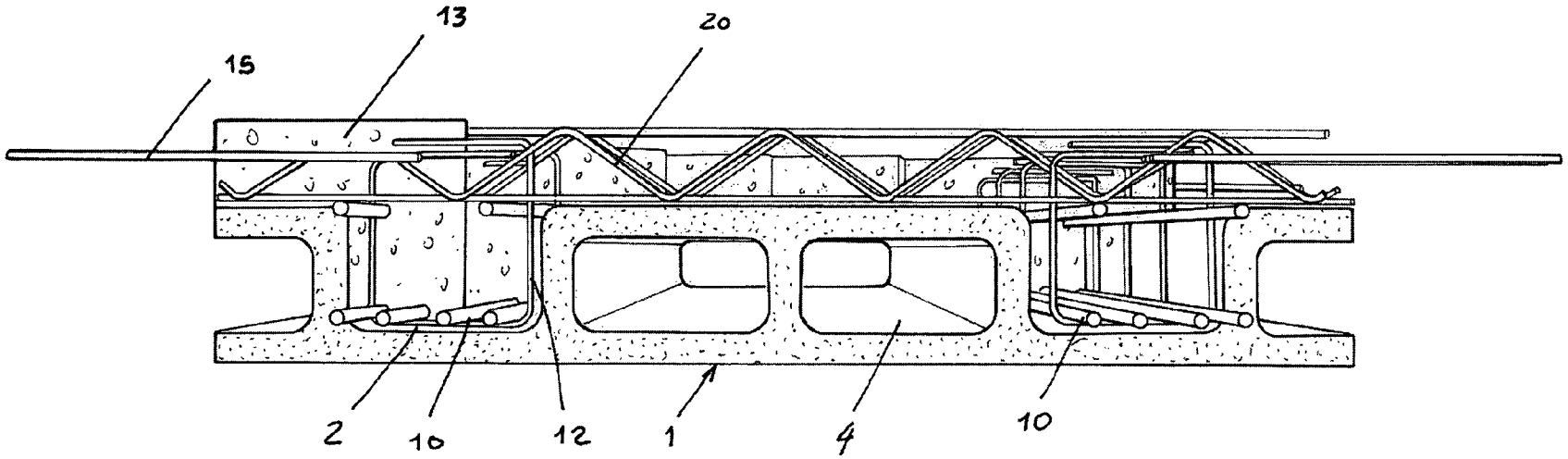
FIG. 14 is a front perspective view showing a ribbed panel including a trellis or lattice reinforcing structure.
Figure 15:
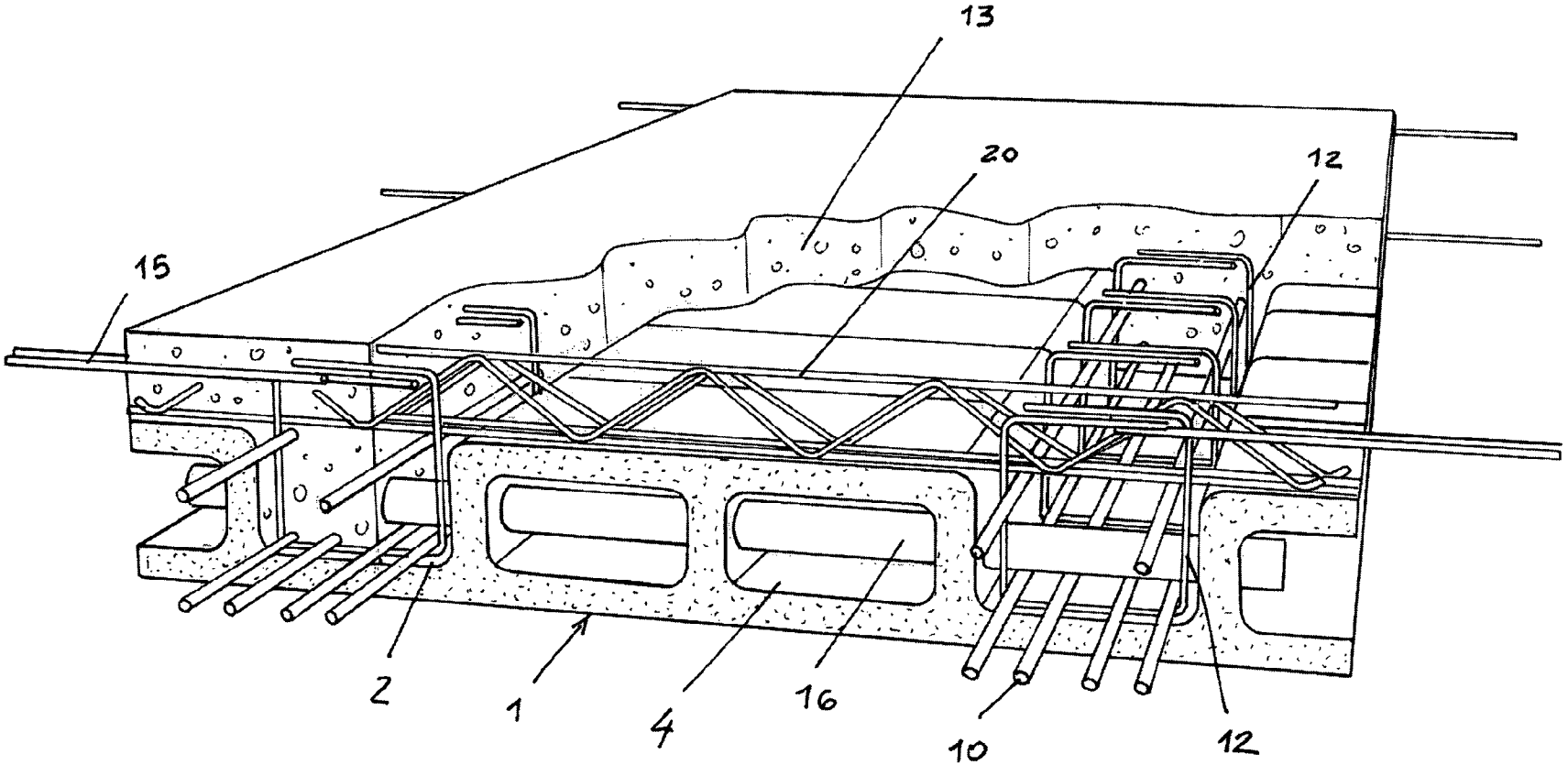
FIG. 15 is a perspective view showing the panel illustrated in FIG. 14.
Figure 16:
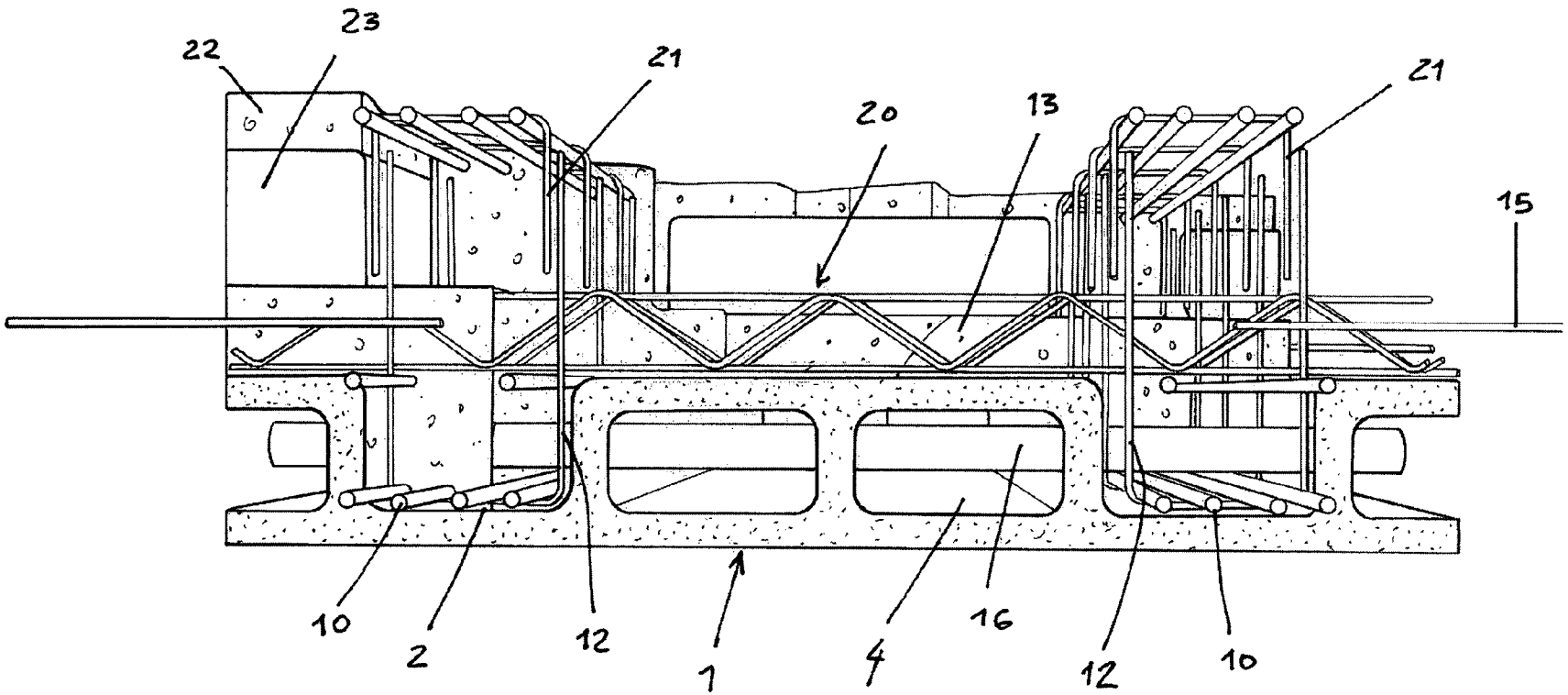
FIG. 16 is a front perspective view of a double-floor slab ribbed panel.
Figure 17:
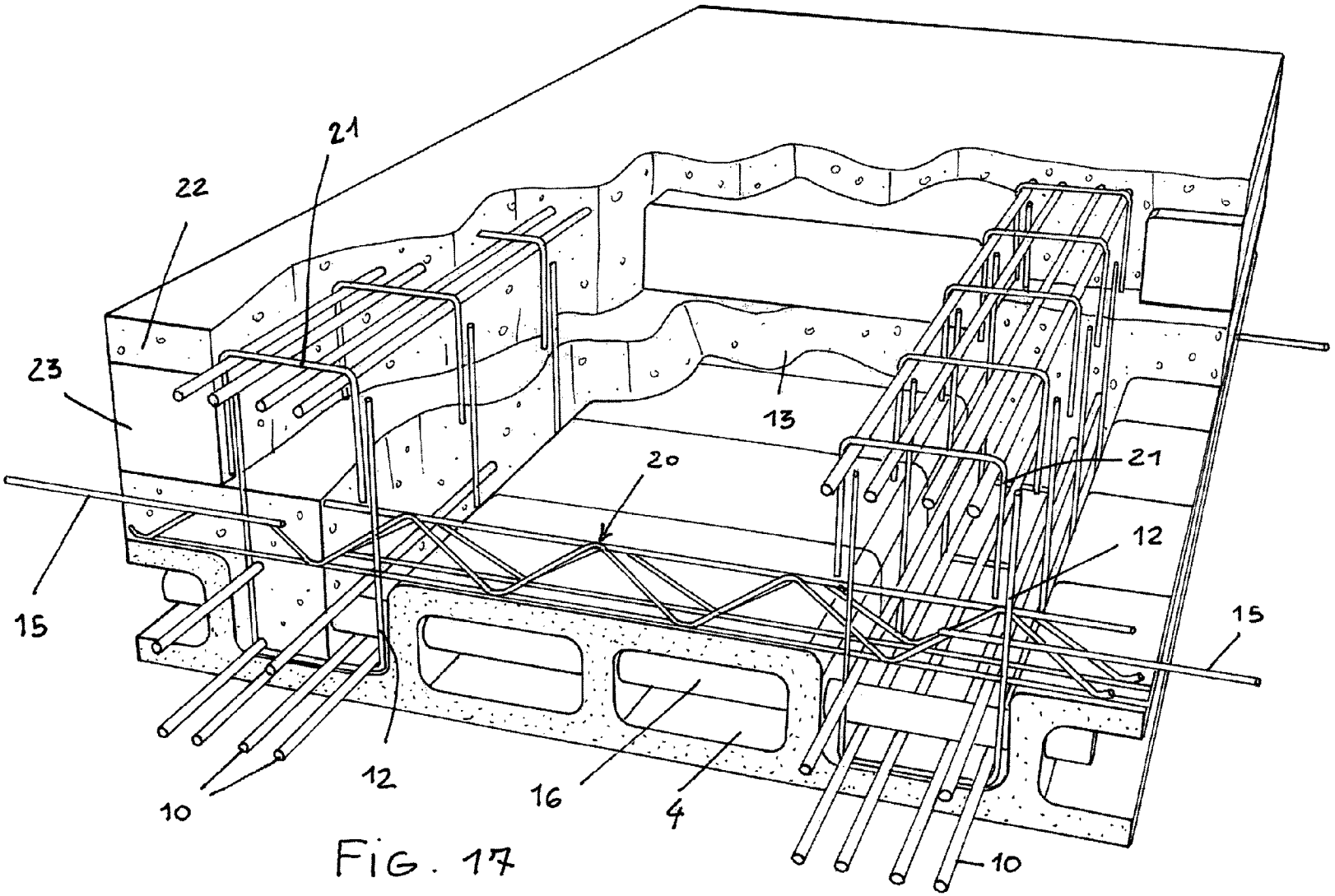
FIG. 17 is a further perspective view of a double floor-slab ribbed panel.

In this case, as shown in FIGS. 8 and 11, a plurality of elongated brackets 21 are herein provided for coupling with the reinforcement brackets 12 and which are embedded in a casting for making the second floor slab 22.

That same casting will also define lightening regions 23 for lightening the overall construction, while providing the desired mechanic strength.

Said regions may also be filled-in by an insulating material, comprising perlite or other thermally-acoustically insulating material, either of a natural or a synthetic type.

The above disclosed construction allows a plurality of systems or plants to be arranged in a throughgoing manner through the second floor slab, in a case in which the lightening regions 23 are left empty. By the above disclosed approach, the panels, pre-packaged and certified, either ventilated or not, will provide a horizontal floor function, inclined or curtain floors or walls, either of a self-supporting or self-bearing type, delimiting homogeneous outer and inner surfaces and containing in their inside the technological apparatus or systems required to provide a desired performance.

Moreover, by using suitable reinforcement iron covers, including connector/spacer elements and owing to the fact that the castings will be protected by transpiring and insulating elements, the assembly will require a less frequent maintenance, while preventing plaster materials from detaching and condensate from forming, the assembling requiring few temporary struts and scaffolds, few operators and raw materials, while minimizing disposable of problems.

Another important aspect of the invention is that working personal will work on a flat slab, and not on curved structures and reinforcement iron elements.

Furthermore, the self-bearing or self-supporting curtains will have target characteristics of fire, water, thermal and acoustic insulation features, and will be integrated with the other horizontal and vertical structures.

The panels, as they are transported, will have a low weight but, after casting, will assume weight values similar to that of prior constructions, notwithstanding a much more important use of conglomerated and steel materials, owing to an elimination of a lot of "lightening" elements and intermediate plaster materials.

To provide a satisfactory high thermally-acoustically insulation of the floor, without using larger thicknesses, the reinforced concrete ribs will be made rigid in the intrados to a bottom beam of lamellar wood, and the assembly will be coated by a layer of a thickness of about 3 cm of a zero class fire resistance material, which will also provide thermoacoustic properties for the same floor.

Thus, it is possible to eliminate, or greatly reduce, possible thermal bridges susceptible to be formed at the rib intrados, thereby providing the ribbed floor slab with the required values.

Figure 18:
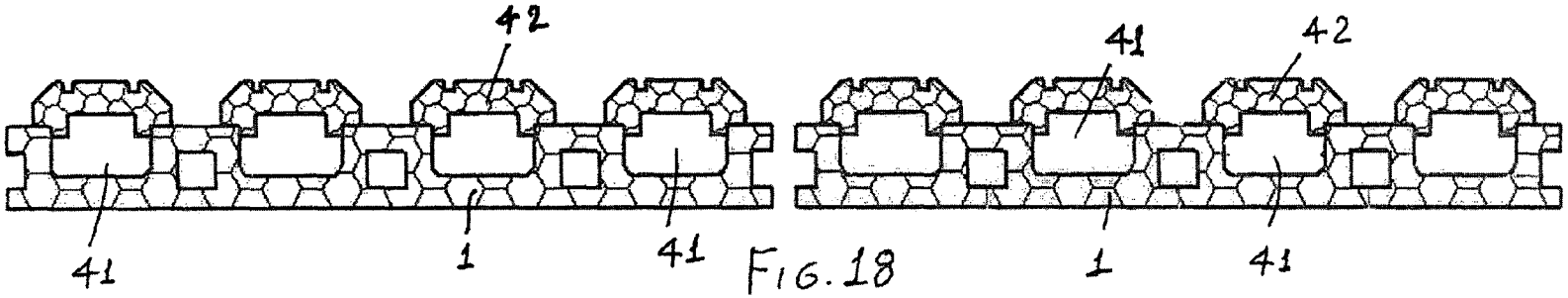
FIGS. 18, 19 and 20 are respective side cross-sectioned views showing a caisson or formwork block 1 comprising a polystyrene, wood/cement, cement mixed perlite or pumice concrete material base.
Figure 19:
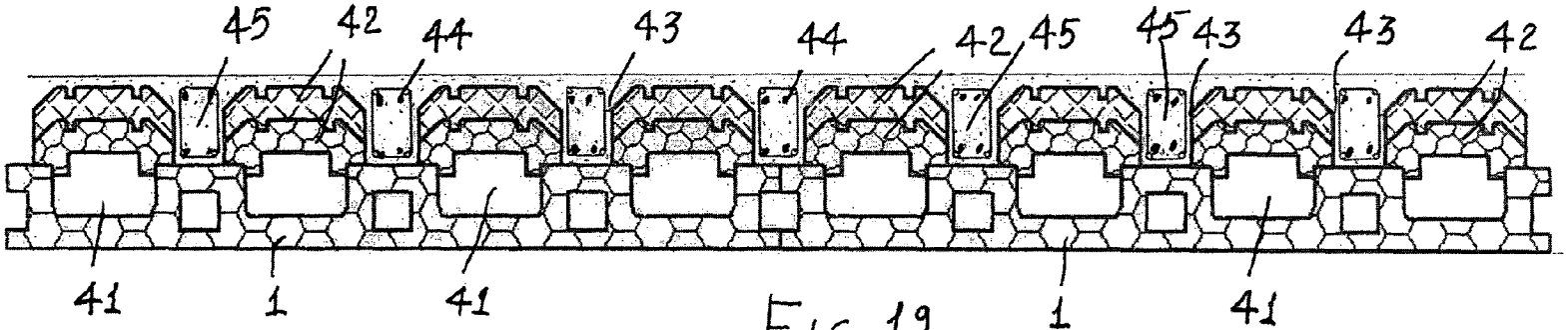
Figure 20:
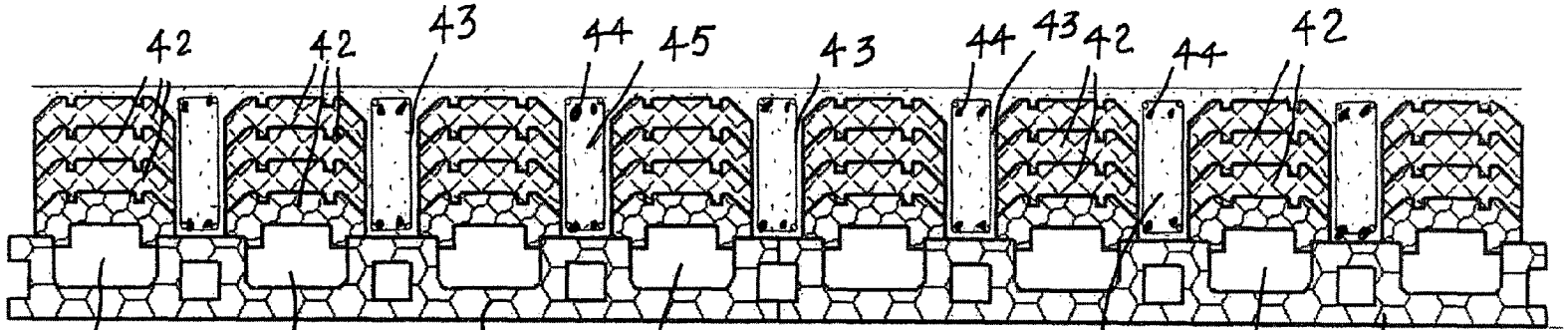

With reference to FIGS. 18, 19 and 20, they show a base arrangement 1, preferably made of a foamed or extruded polystyrene wood/cement, cement mixed perlite or other adhesive or pumice concrete or cellular cement or other thermally acoustically insulating materials.

Said base arrangement 1 is so contoured as to include a plurality of empty or hollow regions 41 for housing technologic systems therein.

On the above polystyrene base, cooperating to form the caisson block 1, additional polystyrene elements 42, in a variable number, may also be applied.

FIGS. 18, 19 and 20 show further polystyrene elements 42, overlapped onto one another, thereby forming projecting regions delimiting cavities 43 for engaging therein different types and shapes reinforcement iron elements 44.

In particular, in said cavities, a concrete material is cast to form small beams 45 the dimensions of which will be delimited by said polystyrene elements 42, constituting, as stated, elements suitable to operate as a formwork, at the concrete casting time.

From the above disclosure, it should be apparent that the invention fully achieves the intended aim and objects.

In particular, the great functionality and use flexibility of the inventive assembly, allowing to achieve optimum operating results, should be apparent.

The invention, as disclosed, is susceptible to several modifications and variations, all coming within the scope of the invention.

Moreover, all the constructional details may be replaced by other technically equivalent elements.

In practicing the invention, the used materials, provided that they are compatible to the intended application, as well as the contingent size and shapes, can be any, depending on requirements.

The invention claimed is:

1. A ribbed panel suitable for installation in a horizontal, vertical or inclined condition, the panel comprising a caisson block base comprising an insulating material having a plurality of recesses (2) and a longitudinal reinforcement structure (10) within the recesses, the longitudinal reinforcement structure adapted to be embedded in a first concrete casting and wherein the panel is configured to be joined to another of the panel in a panel joining region equipped with an electrowelded net, wherein the panel comprises a plurality of reinforced concrete ribs delimiting the recesses (2) wherein the caisson block base comprises any of foamed polystyrene, extruded polystyrene, wood/cement, cement mixed perlite, adhesive or pumice-concrete, cellular cement materials, the caisson block base configured to have a plurality of empty regions for housing therein a technologic system and to which polystyrene elements (42) are attached, the polystyrene elements (42) overlapped onto one another to define projecting regions delimiting cavities (43) for engaging therein reinforcement elements (44) and therein is a cement beam having a size delimited by elements (42), which constitute elements of the caisson block.

2. The panel of claim 1, wherein the caisson block comprises at least one projecting element (3) having a plurality of through-channels (4) therewithin.

3. The panel of claim 1, wherein the panel comprises a plurality of first brackets (21) connected to the longitudinal reinforcement structure (10).

4. The panel of claim 1, wherein the panel comprises through-channels (4) for housing cables therein.

5. The panel of claim 1, wherein the panel further comprises second brackets adapted to be embedded in the first concrete casting for making a second floor slab spaced from the first floor slab.

6. The panel of claim 1, wherein the panel comprises empty regions (23).

7. The panel of claim 1, wherein the panel further comprises a trellis or lattice reinforcement structure for stiffening the first concrete casting.

8. The panel of claim 3, wherein the panel further comprises additional brackets (21) coupled to the first brackets for making a double-floor slab panel arrangement.

9. The panel of claim 1, wherein the panel has a light weight.

10. The panel of claim 1, wherein the panel comprises a lightening material therein, the lightening material comprises any one or more of perlite and another thermally-acoustically insulating material.

11. The panel of claim 1, wherein the caisson is configured to receive a ribbed concrete panel (13) by using the longitudinal reinforcement structure (10) embedded in a concrete casting and configured to be received in recesses (2) of the caisson, the panel further comprising a plurality of brackets (12) adapted to be embedded in the concrete panel (13).

12. The panel of claim 1, wherein the panel further comprises an integrated reinforcement structure (17) configured as a reinforcement trellis.

13. The panel of claim 1, wherein the panel is configured to form a double-floor slab, the double-floor slab having elongated brackets coupled to reinforcement brackets embedded in a concrete casting for use in making the second floor slab, the casting further including lightening regions (23).

14. The panel of claim 1 wherein the ribs are integral with a beam present in a lower part of the panel wherein the beam comprises lamellar wood.

15. The panel of claim 1 further comprising a through duct (16) present in recess (2) and connecting through channels (4).

16. The panel of claim 1 further comprising embedding brackets (12) present in recesses (2).

* * * * *